United States Patent [19]

Link

[11] 4,323,874

[45] Apr. 6, 1982

[54] BLOWN FUSE INDICATOR

[75] Inventor: Edwin A. Link, Waukesha, Wis.

[73] Assignee: RTE Corporation, Waukesha, Wis.

[21] Appl. No.: 173,028

[22] Filed: Jul. 28, 1980

[51] Int. Cl.[3] ..... H01H 85/30

[52] U.S. Cl. ..... 337/244; 337/267

[58] Field of Search ..... 337/244, 241, 267

[56] References Cited

U.S. PATENT DOCUMENTS

| | | | |
|---|---|---|---|
| 2,333,354 | 11/1943 | Andersen et al. | 337/244 |
| 2,639,350 | 5/1953 | Cox | 337/244 |
| 2,797,279 | 6/1957 | Brandt et al. | 337/244 |
| 3,895,338 | 7/1975 | Gray et al. | 337/244 |
| 4,060,786 | 11/1977 | Cuzzone | 337/244 |

*Primary Examiner*—Harold Broome

[57] ABSTRACT

A blown fuse indicator for an electric fuse having a tubular casing of insulating material, a pair of terminal caps mounted on the ends of the casing to close the ends thereof, a fuse link conductively interconnecting the terminal caps and an arc quenching filler material filling the casing to embed the fuse link, the fuse indicator including an indicator housing supported by one of the end caps, a pin type indicator positioned within the housing and biased outwardly from the housing to pierce a plate provided at the outer end of the indicator housing and a pair of members formed of a non-conductive material and having a plurality of corresponding opening in the form of holes or notches with a fuseable wire threaded through the openings to prevent relative movement between the members, one of the members being supported by the housing and the other of the members being connected to the indicator, on fusing of the wire the member connected to the indicator being released allowing the indicator to move to the indicating position.

16 Claims, 7 Drawing Figures

BLOWN FUSE INDICATOR

BACKGROUND OF THE INVENTION

Indicators and striker pins have been used on current limiting fuses and power fuses for many years. They conventionally include red buttons or steel pins which are spring loaded and released upon the operation of the fuse. The driving spring pushes them into a position which allows them to be visually seen by the operating personnel. The striker pin type will usually provide a secondary function by impinging upon other mechanical devices which may trigger loadbreak switches or other devices to go into operation.

SUMMARY OF THE INVENTION

The fuse indicator of the present invention utilizes a pair of non-conductive members to hold the striker pin in a state of potential force due to the bias of a spring. A nichrome wire is threaded through the members to preferably provide several linkages between the members to retain the members in position and thus lock the pin in a driving position until the fuse blows. When the fuse blows the nichrome wire is vaporized to release the member connected to the pin thus allowing the spring to drive the pin to its blown or indicating position.

THE DRAWINGS

DESCRIPTION

Figure 1:
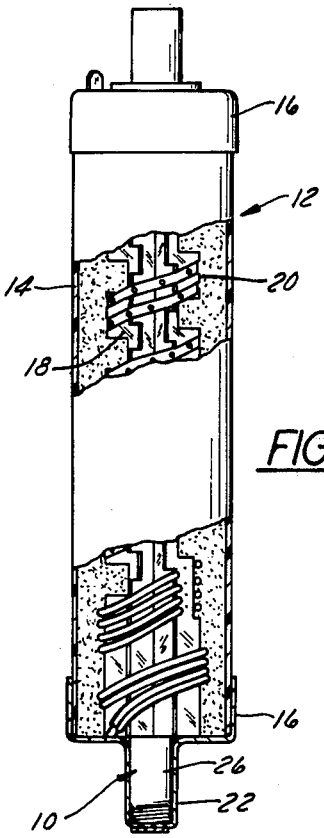
FIG. 1 is an elevation view partly in section showing a typical current limiting fuse employing the blown fuse indicator of the present invention.

The indicator assembly 10 according to the present invention is shown mounted in one end of a current limiting fuse 12. The current limiting fuse is of a conventional type including a tubular insulating housing 14 having a pair of terminal end caps 16 mounted on the ends thereof. A spider 18 is provided within the housing 14 and a full range fuse link 20 is spirally wrapped around the spider 18 and connected to each of the end caps 16.

Means are provided in one of the end caps 16 for supporting the indicator assembly 10. Such means is in the form of a tubular extension 22 which has an opening 24 at the outer end. Means in the form of a thin plate 54 are provided on the end of the extension 22 to close the opening 24.

In accordance with the invention, the indicator assembly 10 includes a metal housing 26 having an opening 28 at one end and a threaded section 30 at the other end. The housing 26 being positioned within the extension 22. Means are provided within the housing 26 for signaling a blown fuse. Such means is in the form of a pin 32 having an enlarged head 34. The head 34 is provided with a threaded section 36. The striker pin 32 is biased outwardly from the housing 26 by means of a spring 38. In this regard, it should be noted that the spring 38 is attached to the threads 36 on the head 34 of the striker pin 32 and to the internal threaded section 30 at the open end of the housing 26.

The striker pin 32 is held in a driving position within the housing 26 by means of a holding assembly 25 which includes a pair of non-conductive members 40 and 42 and a vaporizable wire 44. The members 40, 42 can be in the form of mica plates. In this regard, it should be noted that the mica plate 40 is secured to a washer 46 having an opening 48. The washer 46 is located on the inner end of the housing 26. The mica plate 42 is attached to the head 34 of the striker pin 32 and projects outwardly through the opening 28 in the casing and the opening 48 in the washer.

Figure 2:
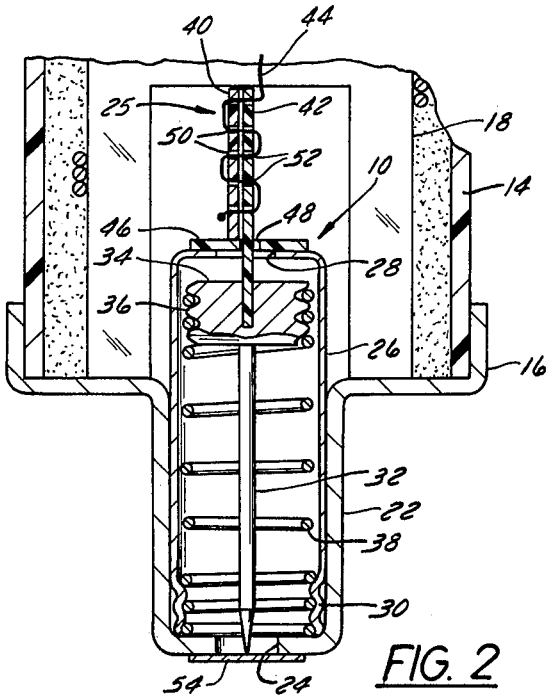
FIG. 2 is an enlarged view in section of the indicator assembly shown in the driving position.
Figure 3:
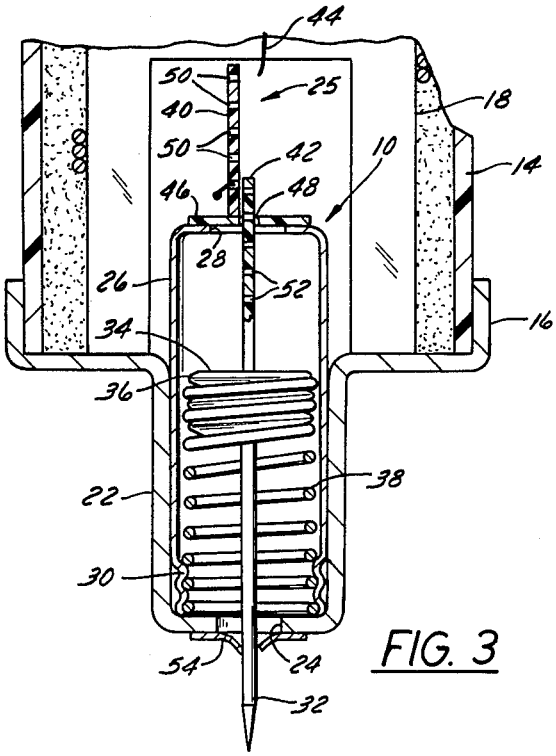
FIG. 3 is a view similar to FIG. 2 showing the striker pin in the blown position.

Means are provided for interconnecting the members 40 and 42 to hold this striker pin in a driving position. Such means can be in the form of a plurality of openings, such as holes or notches, through which wire 44 is threaded to provide several linkages between member 40 and 42. As seen in FIGS. 2 and 3, such means is in the form of holes 50 and 52, respectively, which are located in corresponding positions relative to each other. The members are held in a locked or fixed position by means of the vaporizable wire 44 which is threaded through the holes 50 and 52 in the members. The vaporizable wire 44 can be formed of a material such as nichrome. The inner end of the wire 44 is electrically connected to the fuse link 20 in the fuse housing. The end of the striker pin 36 is located in close proximity to the thin plate 54 so that it will penetrate the plate on fusing of the wire 44.

In this regard, when the current limiting fuse encounters a fault current, the fuse link 20 normally vaporizes to interrupt the current. The fault current will then be transferred to the nichrome wire 44 which also vaporizes. Once the nichrome wire has vaporized, mica plate 42 is free to move relative to the mica plate 40 thus allowing the spring 38 to drive the striker pin through the plate 54. Once the striker pin passes through the plate 54 it can be easily observed by the operator or it can be used to actuate secondary switches for operating other devices in the line.

Figure 5:
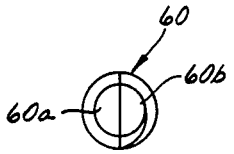
FIG. 5 is an end view of the assembly shown in FIG. 4.
Figure 4:
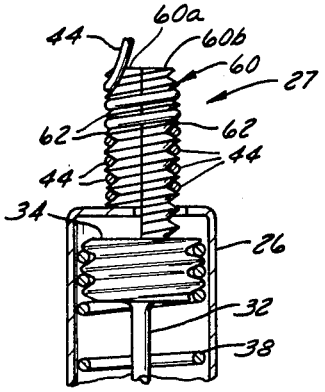
FIG. 4 is an elevation view of an alternate form of holding assembly formed from a split ceramic screw.

In the alternate form of the holding assembly 27 shown in FIGS. 4 and 5 the non-conductive member is in the form of a ceramic screw 60 having screw threads 62 mounted on the end of the housing 26. The screw 60 is split to provide a fixed section **60*a* and a moveable section 60*b*. The fixed being secured to the housing 26 and the moveable section being secured to the head 34 of the striker pin 32. The vaporizeable wire 44 is spirally wrapped around the notches formed by the threads 62 in the screw 60 to provide several linkages between sections 60*a* and 60*b*. On vaporization of the wire 44, the moveable section will be released to move with striker pin 32**.

Figure 7:
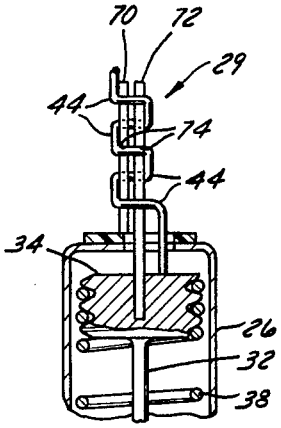
FIG. 7 is a side view of the assembly shown in FIG. 6.
Figure 6:
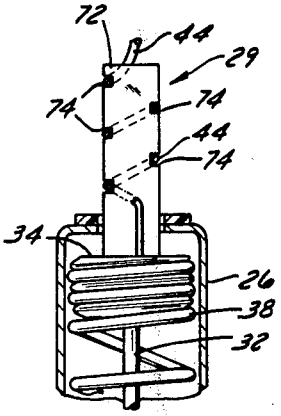
FIG. 6 is an elevation view of another form of holding assembly formed from a pair of notched plates.

In the alternate form of the holding assembly 29 shown in FIGS. 6 and 7, a pair of mica plates 70, 72 mounted on the end of the housing 26. Plate 70 is secured to the housing and plate 72 is secured to the head 34 of the striker pin 32. Each of the plates is provided with a series of off set notches 74 provided in the edges of the plates 70 and 72. The vaporizable wire 44 is wrapped around the plates 70, 72 in the notches 74 to provide several linkages between the mica plates 70,72.

On vaporization of the wire 44, the plate 72 will be free to move with the striker pin 32.

I claim:

1. In a current limiting fuse of the type having a tubular casing of insulating material, an electrically conductive terminal cap mounted on each end of the casing, a fuse link positioned within the casing and interconnecting the terminal caps, and an arc quenching material completely filling the inside of the casing and embedding the fuse link, the improvement comprising a blown fuse indicator assembly supported by one of said caps; said assembly including, a housing, a striker pin positioned within said housing, means within the housing for driving the striker pin to an indicating position and a second means for holding the striker pin in a driving position; such second means including a vaporizable wire connected to the fuse link, a first non-conductive member connected to said pin, a second non-conductive member connected to said housing, said members each having a plurality of corresponding openings, said wire extending through said openings in said members whereby upon vaporizing of said wire said first non-conductive member is free to move with respect to said second non-conductive member.

2. The fuse according to claim 1 wherein said wire is formed from nichrome.

3. The fuse according to claim 1 wherein said members are formed from mica.

4. The fuse according to claim 3 wherein said openings are holes and said wire is threaded through the holes.

5. The fuse according to claim 3 wherein said openings are notches and said wire is wrapped in said notches.

6. The fuse according to claim 1 wherein said non-conductive members are formed from a split screw and said openings are notches formed by the threads of said screw.

7. A blown fuse indicating and/or striking device for a fuse having a fuse link interconnecting the terminal caps on the ends of a tubular casing, said device comprising, a moveable striker pin supported within one of said terminal caps, means for driving said pin through said terminal cap to an indicating position and/or striking position, a vaporizable wire connected to said fuse link, a first non-conductive member connected to said pin, a second non-conductive member connected to said terminal cap; said members each having a plurality of corresponding openings; said wire retentively connecting said members via said openings to provide several linkages between said members for holding said pin within said cap whereby on vaporizing of said wire said pin will be released to an indicating and/or striking position.

8. An indicating and striking device for a fuse, said fuse including a housing having an end cap at each end, one of said caps having a tubular extension and a fuse link interconnecting said caps, said device comprising a metal housing adapted to be mounted in said extension and having an opening at each end, a striker pin positioned within said casing, a spring secured to said housing for biasing said pin to an indicating or striking position, and means for holding said pin within said housing until the fuse link blows, said means including a first mica plate secured to said pin and having a number of openings thereon;

a second mica plate secured to said housing and having a number of openings corresponding to the number of openings in said first plate, and a vaporizeable wire threaded through said openings in said plates and being connected to said fuse link whereby said wire will vaporize when said fuse blows to release the pin for movement to an indicating position.

9. A current limiting fuse comprising: a tubular casing of insulating material, a pair of terminal caps mounted on the ends of said casing and closing the ends thereof, a fuse link conductively interconnecting said pair of terminal caps, a pulverulent arc-quenching filler inside said casing embedding said fuse link, a housing supported by one of said terminal caps, a moveable blown fuse indicator within said housing, means for biasing said indicator toward an indicating position, and means, exterior to said housing, including a stationary non-conductive member, a second non-conductive member connected to said indicator; said members having a plurality of corresponding openings, and a vaporizable wire extending through said openings to prevent relative movement of said non-conductive members, said wire being electrically connected to said link whereby, on fusing of said link, said wire vaporizes allowing said indicator to move to an indicating position.

10. The fuse according to claim 9 wherein said stationary non-conductive member is connected to said housing.

11. The fuse according to claim 9 or 10 wherein said openings are holes and said wire is threaded through said holes.

12. The fuse according to claim 9 or 10 wherein said openings are notches and said wire is wrapped in said notches.

13. The fuse according to claim 9 or 10 wherein said non-conductive members are formed from a split screw and said openings are the notches formed by the threads of said screw.

14. A blown fuse indicating and/or striking device according to claim 7 wherein said openings are holes in said non-conductive members and said wire is threaded through said holes to provide said linkages between said non-conductive members.

15. A blown fuse indicating and/or striking device according to claim 7 wherein said openings are notches and said wire is wrapped in said notches to provide said linkages between said non-conductive members.

16. A blown fuse indicating and/or striking device according to claim 7 wherein said non-conductive members are formed from a split screw and said openings are notches formed by the threads of said screw; said wire being wrapped around several of the threads of said screw to provide said linkages between the portions of said split screw.

* * * * *